US006023794A

United States Patent [19]

Nein

[11] Patent Number: 6,023,794

[45] Date of Patent: Feb. 15, 2000

[54] SHOWER DOOR ASSEMBLY

[76] Inventor: John H. Nein, 4854 Jellett St., San Diego, Calif. 92110

[21] Appl. No.: 09/113,407

[22] Filed: Jul. 10, 1998

[51] Int. Cl.[7] ..... A47K 3/22

[52] U.S. Cl. ..... 4/607; 4/610; 4/557

[58] Field of Search ..... 4/607, 609, 610, 4/557, 559, 584, 605, 612

[56] References Cited

U.S. PATENT DOCUMENTS

| | | | |
|---|---|---|---|
| 4,358,863 | 11/1982 | Jacobsen | 4/607 |
| 4,445,239 | 5/1984 | Jacobsen | 4/607 |
| 4,987,619 | 1/1991 | Smith | 4/612 |
| 5,263,208 | 11/1993 | Smith | 4/612 |
| 5,778,463 | 7/1998 | Teckchandani et al. | 4/584 |

*Primary Examiner*—David J. Walczak
*Attorney, Agent, or Firm*—John R. Ross; John R. Ross III

[57] ABSTRACT

An improvement to a sliding door system for a shower-bathtub installed adjacent to three walls of a bathroom. The sliding door system includes an upper track that has the following elements: (1) at least two wheel supports, (2) at least two wheel stays positioned above the two wheel supports, and (3) at least two lower bearing supports positioned at least five inches below the two wheel supports. The upper track is rigidly attached to the two short walls of the shower-bathtub and provides enough support so that the presence of a lower track is unnecessary. In a preferred embodiment, the outside wall of the bathtub and the two short shower walls comprise molded dams.

20 Claims, 11 Drawing Sheets

SHOWER DOOR ASSEMBLY

This invention relates to shower-bathtub combinations, and more particularly to shower-bathtub combinations having sliding doors.

BACKGROUND OF THE INVENTION

A shower-bathtub combination, hereinafter called a shower-bathtub, is well known in the art. Shower-bathtubs typically have a rectangular configuration and are usually installed adjacent to three walls in a bathroom. The two short sides of the shower-bathtub being adjacent to walls which Applicant refers to as short walls and a long side being adjacent to a wall which Applicant will refer to as the long inside wall. The shower-bathtub can be used to take either a tub bath or a shower. A shower door or a shower curtain is typically provided to furnish a fourth outside shower wall to prevent water from splashing out of the shower-bathtub when the shower is being used.

Shower curtains typically are flimsy, tend to gather mold and need to be cleaned regularly. Moreover, they are also relatively ineffective in preventing all water from splashing out of the shower. However, there is no ugly track along the top of the outside wall of the bathtub.

Prior art shower doors, are typically not as flimsy as shower curtains and are less likely to gather mold, but they also have serious faults. Usually shower door assemblies have two sliding doors and are sold with a track system that permits the doors to slide horizontally. This track system usually comprises a top track and a bottom track. Two rollers are typically attached at the top of each of the two doors and the rollers roll in the top track. Some sort of roller or tab is normally attached at or near the bottom of the door which runs in the bottom track which is normally mounted on the top of the outside side of the bathtub portion of the shower-bathtub. A dam is normally part of the bottom track and runs along the bottom of the doors and outside of the doors to force water running down the inside of the doors to flow into the shower-bathtub. The track along the top of the outside side of the bathtub is generally considered ugly and detracts from the beauty of a well-designed bathtub.

What is needed is a better shower door assembly.

SUMMARY OF THE INVENTION

The present invention provides an improvement to a sliding door system for a shower-bathtub installed adjacent to three walls of a bathroom. The improvement comprises an upper track that has the following elements: (1) at least two wheel supports, (2) at least two wheel stays positioned above the two wheel supports, and (3) at least two lower bearing supports positioned at least five inches below the two wheel supports. The upper track is rigidly attached to the two short walls of the shower-bathtub and provides enough support so that the presence of a lower track is unnecessary. In a preferred embodiment, the outside wall of the bathtub and the two short shower walls comprise molded dams.

DETAILED DESCRIPTION OF THE PREFERRED EMBODIMENT

Figure 1:
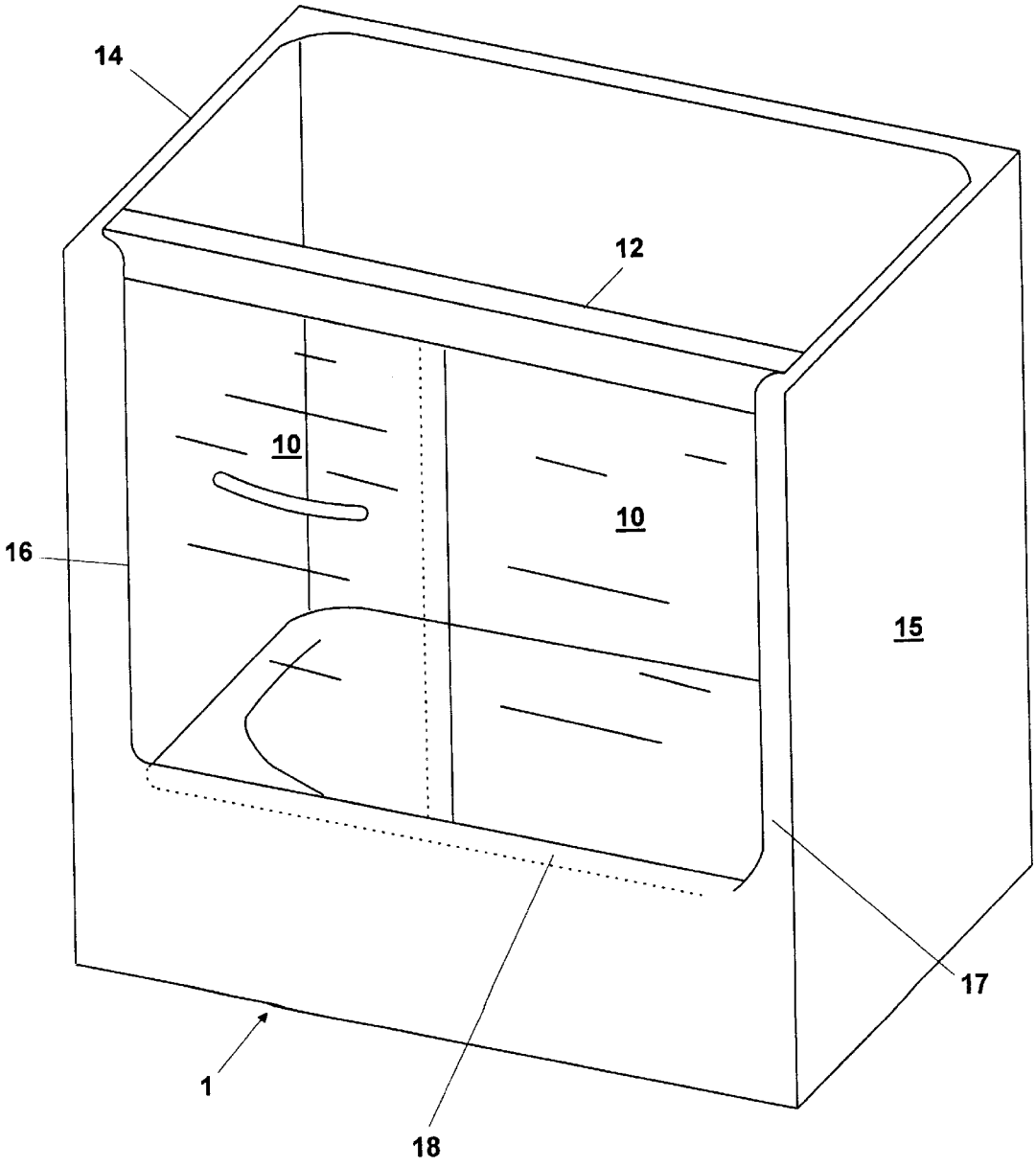
FIG. 1 shows a perspective view of a preferred embodiment of the present invention.
Figure 2:
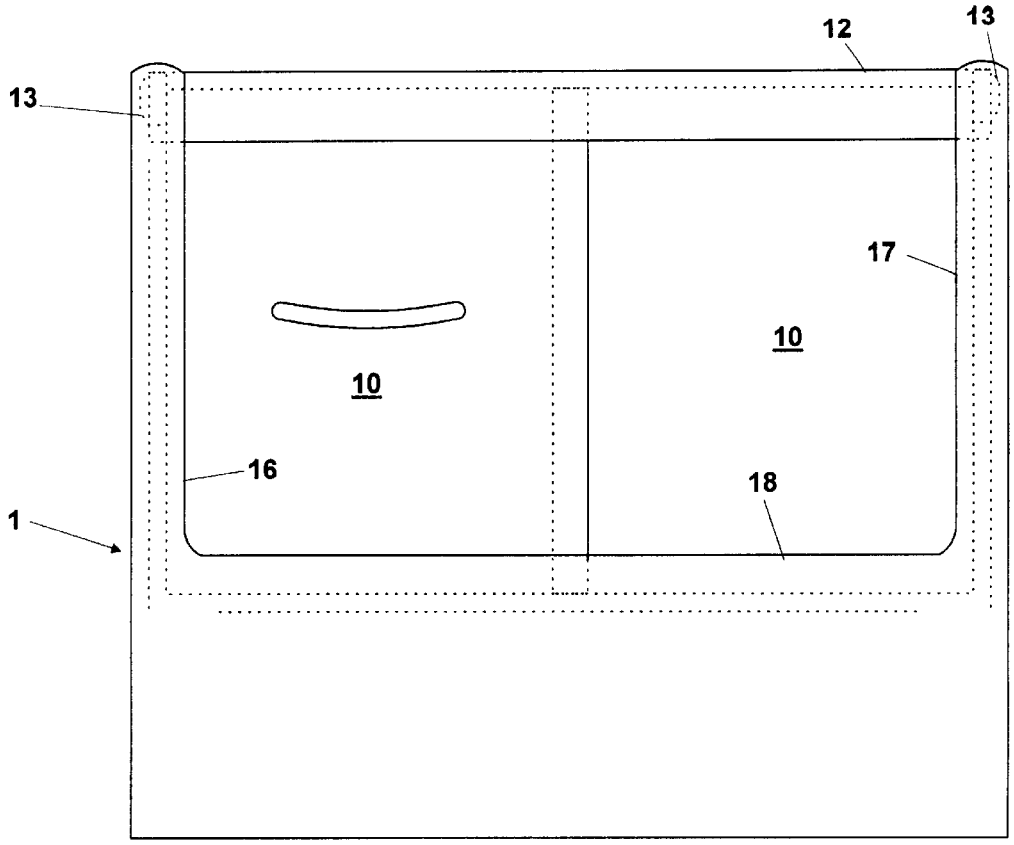
FIG. 2 shows a side view of a preferred embodiment of the present invention.
Figure 3:
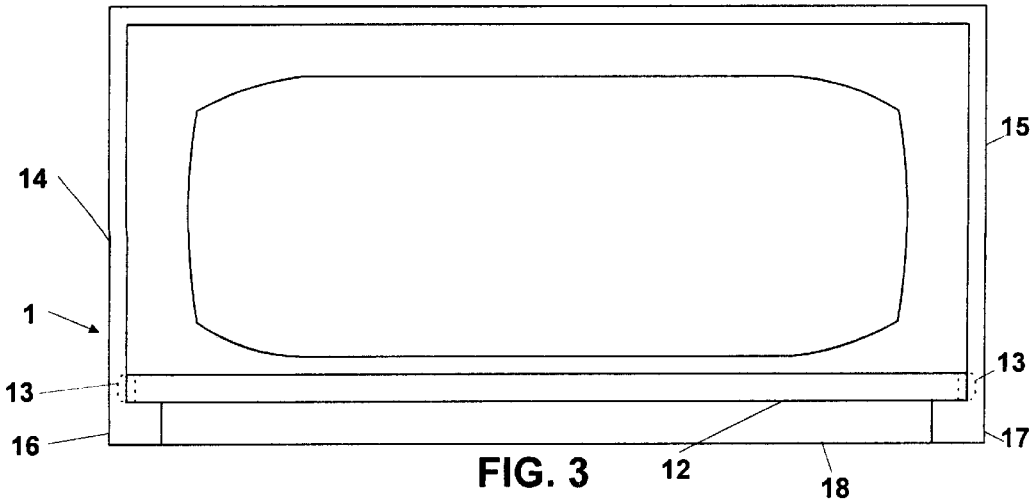
FIG. 3 shows a top view of a preferred embodiment of the present invention.
Figure 4:
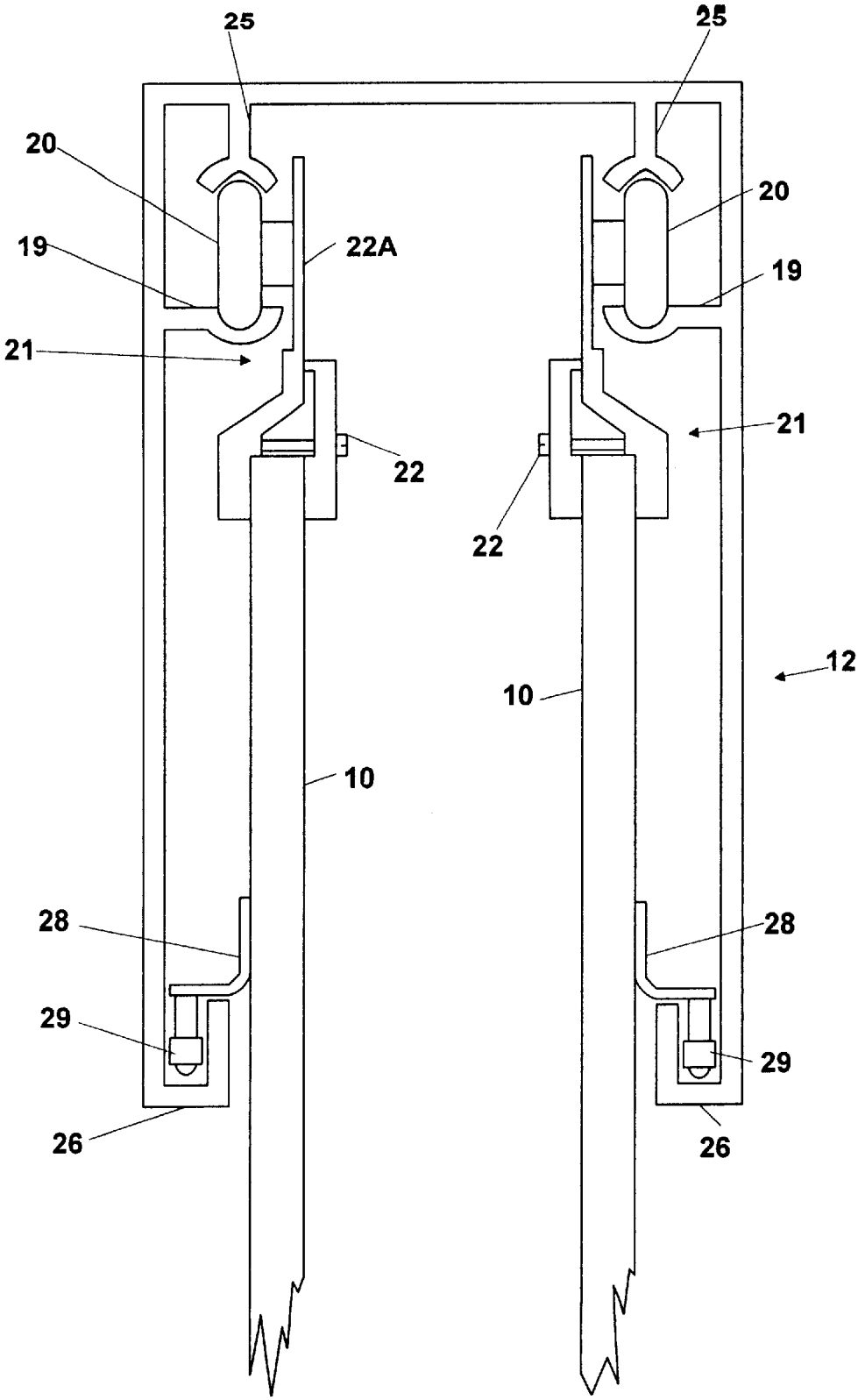
FIG. 4 shows a cross section view of the upper track.

FIG. 1 presents a perspective view of a shower-bathtub that could utilize a preferred embodiment of the present invention. Also, FIG. 2 presents a side view and FIG. 3 presents a top view of the shower-bathtub. In the preferred embodiment, shower-bathtub 1 is formed from a fiberglass mold in the usual manner. FIG. 4 shows the principal features of the present invention. Glass sliding doors 10 rollingly hang from upper aluminum track 12 as shown in FIG. 4. Sliding doors 10 are made from ¼ inch thick tempered glass. Side dams 16 and 17 and lower dam 18 are located on the front side of shower-bathtub 1 and function to prevent water from leaking outside of shower-bathtub 1 while it is in operation. Rubber mounts 13 rigidly mount track 12 to left wall 14 and right wall 15.

Upper Track

Figure 5:
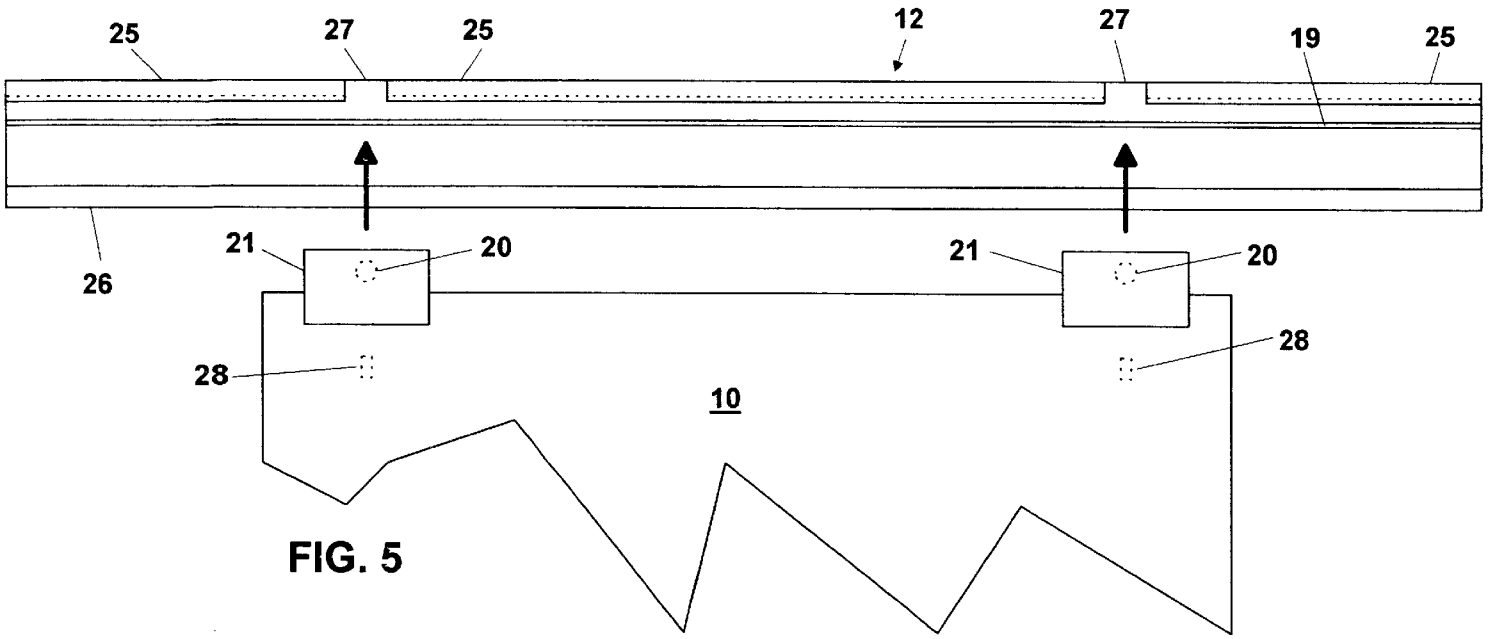
FIG. 5 shows a lengthwise view of the inside of the upper track and how to mount a shower door onto the upper track.

A detailed cross sectional view of upper aluminum track 12 is presented in FIG. 4 and a lengthwise view of the inside of track 12 is presented in FIG. 5. Upper aluminum track 12 is fabricated using 1/16-inch thick aluminum. Aluminum track 12 has wheel support 19 located 1¼-inches below the top of track 12. Also, wheel stay 25 extends ½-inch down from the top of track 12 and functions to prevent wheel 20 from falling off wheel support 19. Lower bearing support 26 is a U-shaped groove at the bottom of track 12 and functions along with bearing 29 attached to door 10 with bracket 28 to prevent rocking motion of sliding doors 10. In this preferred embodiment groove 26 is about 6 inches below wheel support 19. This distance could be increased to provide increased resistance to rocking motion of the doors, but the distance between support 19 and groove 26 should not be less than 5 inches. Wheel stays 25 have cutouts 27, as shown in FIG. 5. Cutouts 27 function to allow loading of doors 10 onto track 12, also shown in FIG. 5.

Mounting Upper Track to Shower-Bathtub

Figure 7:
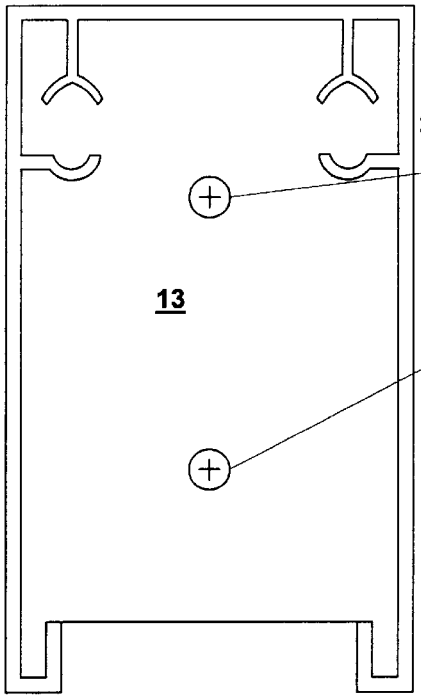
FIGS. 7 and 8 show the rubber mount.
Figure 8:
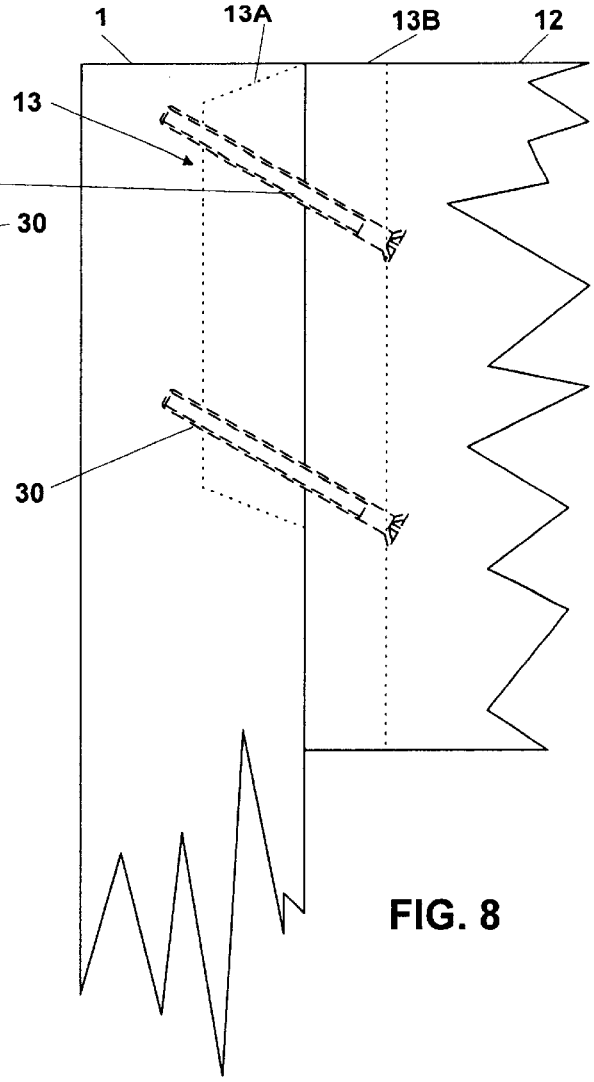

Upper track 12 is mounted to shower-bathtub 1 with rubber mounts 13 as shown in FIGS. 2 and 3. A more detailed view of the mounting assembly is given in FIGS. 7 and 8. As shown in FIG. 7, rubber mount 13 fits snuggly in the cross section of track 12. Rubber mount 13 is made of rubber having a durometer hardness of 0.80. A side view of rubber mount 13 is given in FIG. 8. Rubber mount 13 is a solid piece of rubber that has two parts: track support section 13B and wall insertion section 13A. Track support section 13B extends ⅜ inch into track 12. Wall insertion section 13A extends ⅜ inch into shower-bathtub 1. For extra support, mount 13 is rigidly secured to the short walls of shower-bathtub 1 by means of screws 30. Screws 30 are screwed into wall 14,15 at a 30-degree angle for maximum support.

Connecting Sliding Doors to Upper Track

Figure 6:
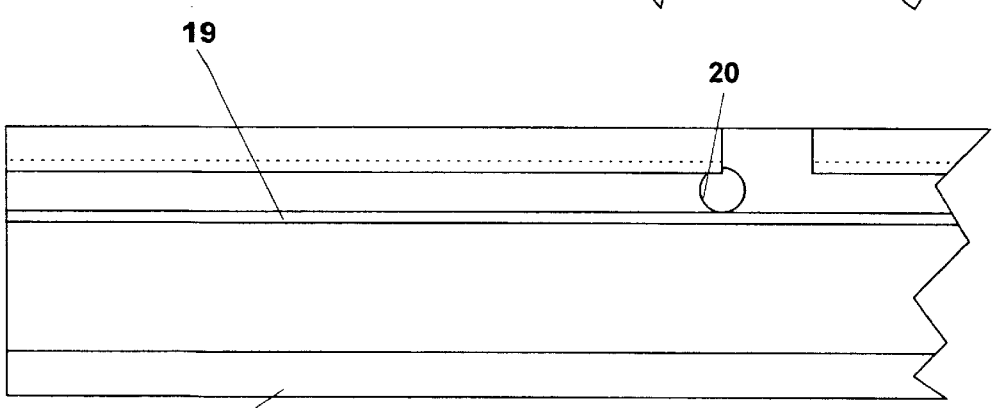
FIG. 6 shows how a wheel from the wheel attachment assembly rolls on the upper track.

Wheel attachment assembly 21 is rigidly connected to the top of doors 10 by tightening screw 22 against clamping section 22A, as shown in FIG. 4. Wheel attachment assembly 21 is available from Alumax with offices in Magnolia, Ark., part number 8239. Wheels 20 are made of plastic and have a diameter of ¾-inch. Doors 10 are mounted so that wheels 20 roll on wheel support 19 as shown in FIG. 4 and FIG. 6. There is a 1/16-inch clearance in-between wheels 20 and wheel stay 25 so that wheels 20 may freely roll on wheel support 19 without skidding against wheel stay 25, as shown in FIG. 4 and FIG. 6. L-bracket 28 is glued to doors 10 as shown in FIGS. 4 and 5. Rotationally attached to L-bracket 28 is bearing 29. Bearing 29 is ¼ inch in diameter.

Figures 1A, 1B:
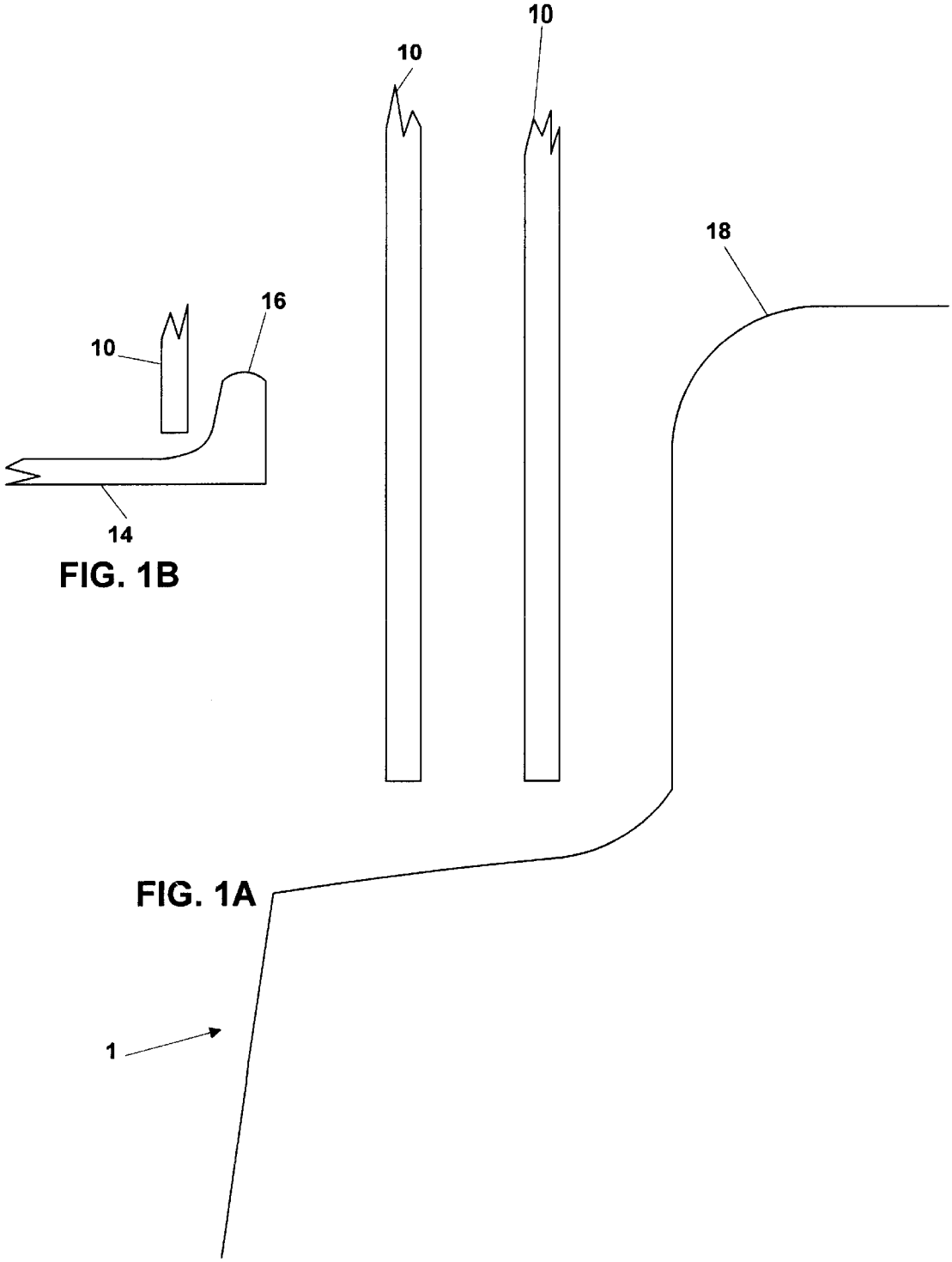
FIG. 1A shows the lower dam molded into the top edge of the outside side of the tub.
FIG. 1B shows a vertical dam molded into the outside edge of one of the two short shower walls.

To load doors 10 onto track 12, doors 10 are lined up underneath track 12 so that wheel assemblies 21 are directly underneath cutouts 27. Doors 10 are then raised up to track 12. Bearing 29 is then slid at an angle into lower bearing support 26 as shown in FIG. 4. Then, wheels 20 are placed on wheel support 19 at a position directly underneath cutouts 27. This procedure is repeated with the second door 10 until both doors are loaded onto upper track 12 as shown in FIG. 4. In this preferred embodiment, the bathtub is a molded fiberglass shower-bathtub and the top surface of the outside wall of the bathtub is molded in the shape shown in FIG. 1A to form a dam along the top edge of the outside side of the tub. Also, the outside edges of the two short shower walls are molded in the shape shown in FIG. 1B to form vertical dams. The doors slide inside these dams.

Second Preferred Embodiment

Figure 9B:
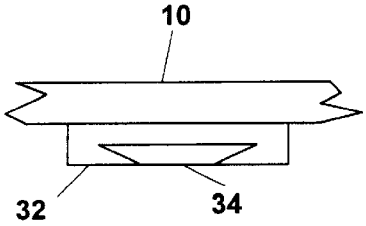
FIG. 9B shows a top view of the lower track insert and insert housing.
Figure 9A:
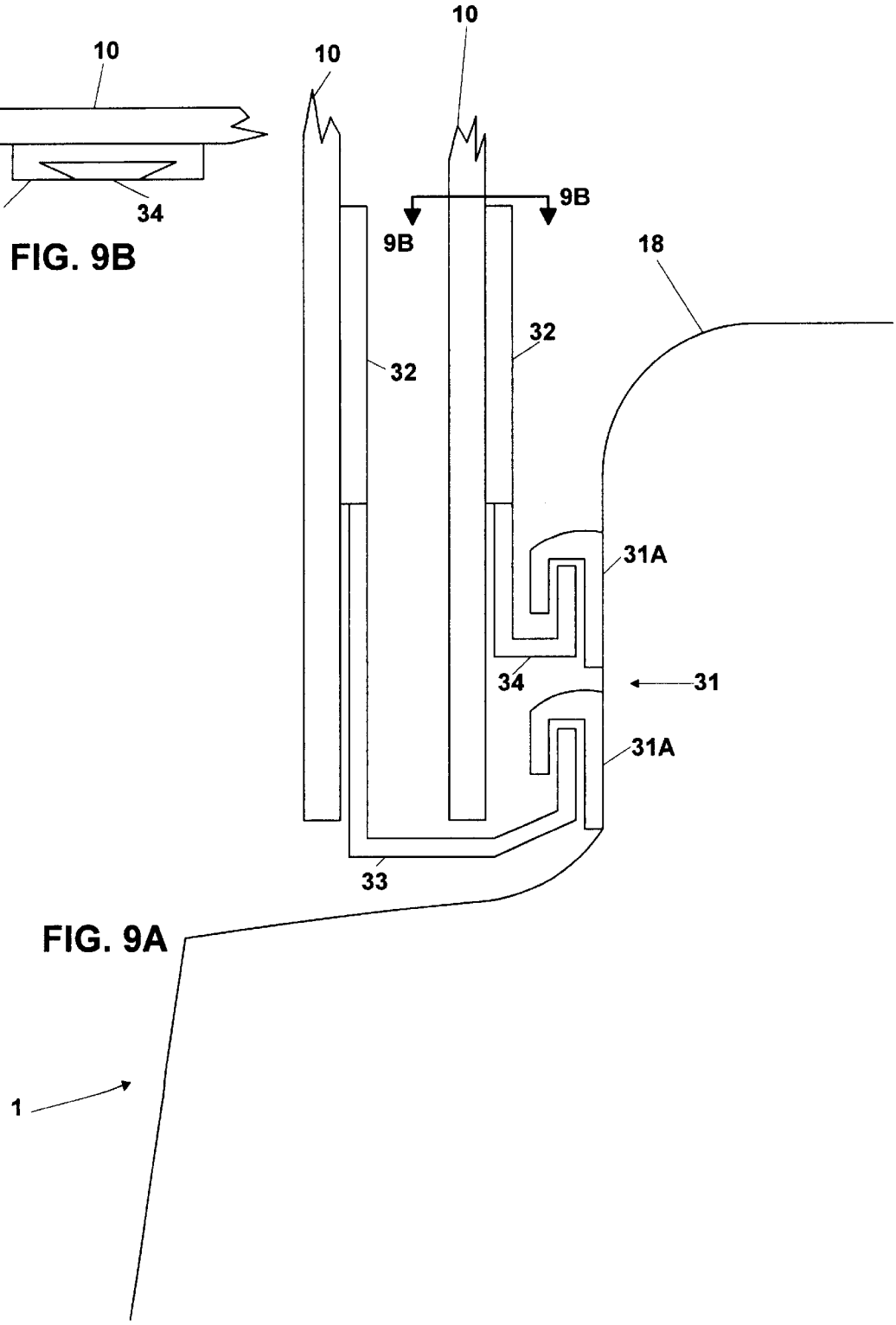
FIG. 9A shows the doors sliding on the lower track.

The major advantage of upper track 12 over prior art systems is that lower bearing support 26 of track 12 sufficiently prevents rocking of doors 10 so that a lower track mounted on the top outside edge of the bathtub is unnecessary. This is highly desirable because lower tracks in prior art shower door assemblies are aesthetically unpleasing and are a collector of mold and bacteria. Nevertheless, some users may still desire a lower track for redundancy. FIGS. 9A and 9B show how a lower track may be used with the present invention. FIG. 9A shows a side view of the inside of lower dam 18. Lower track 31 contains two U-shaped plastic strips 31A. U-shaped strips 31A are glued to lower dam 18 and extend the length of lower dam 18. Glued to the bottoms of each door 10 are insert housings 32. A top view of insert housing 32 is presented in FIG. 9B. Slidingly connected to insert housings 32 are lower track inserts 33 and 34. Insert housings 32 and lower track inserts 33 and 34 are both made from molded hard plastic. Friction force between insert housings 32 and lower track inserts 33 and 34 is sufficient to hold lower track inserts 33 and 34 in place and engaged with lower track 31 as shown in FIG. 9A to provide maximum support for doors 10. However, the friction force is also sufficiently weak so that finger force is enough to push lower track inserts 33 and 34 downward so that doors 10 can be easily installed or removed from lower track 31.

Other Embodiments

Figure 10:
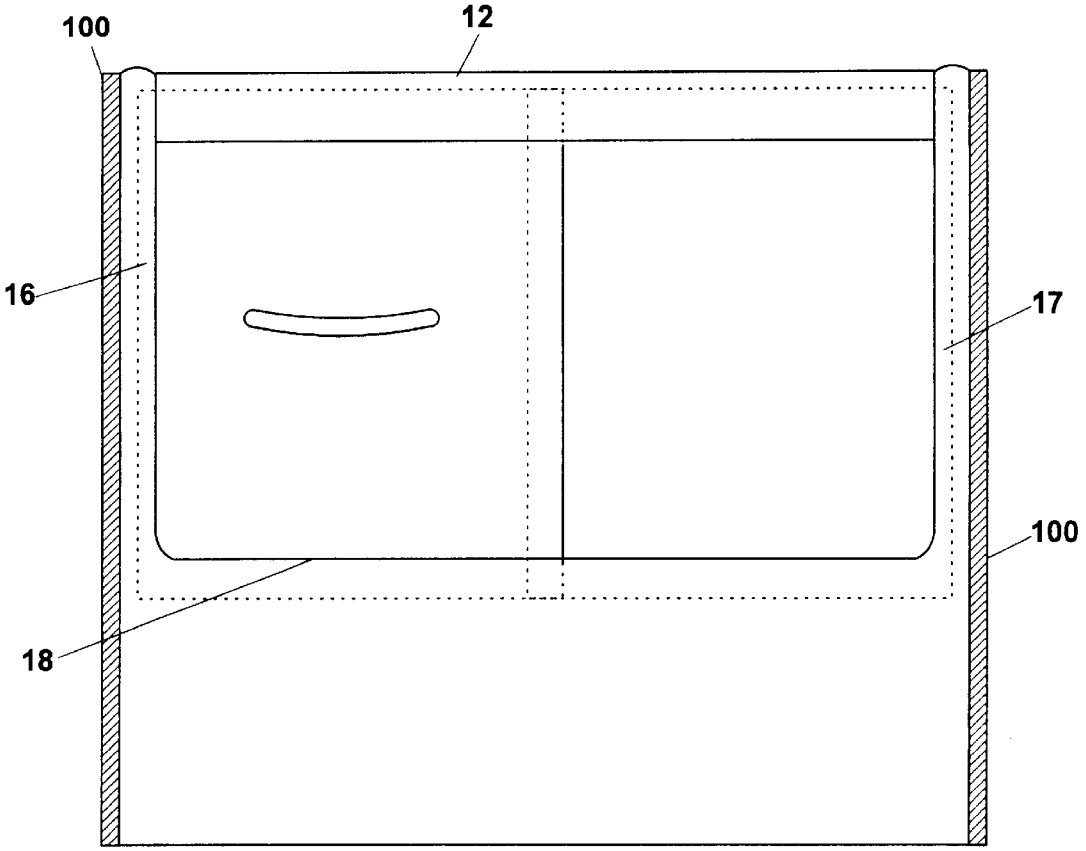
FIG. 10 shows a side view of another prefered embodiment of the present invention.
Figure 11:
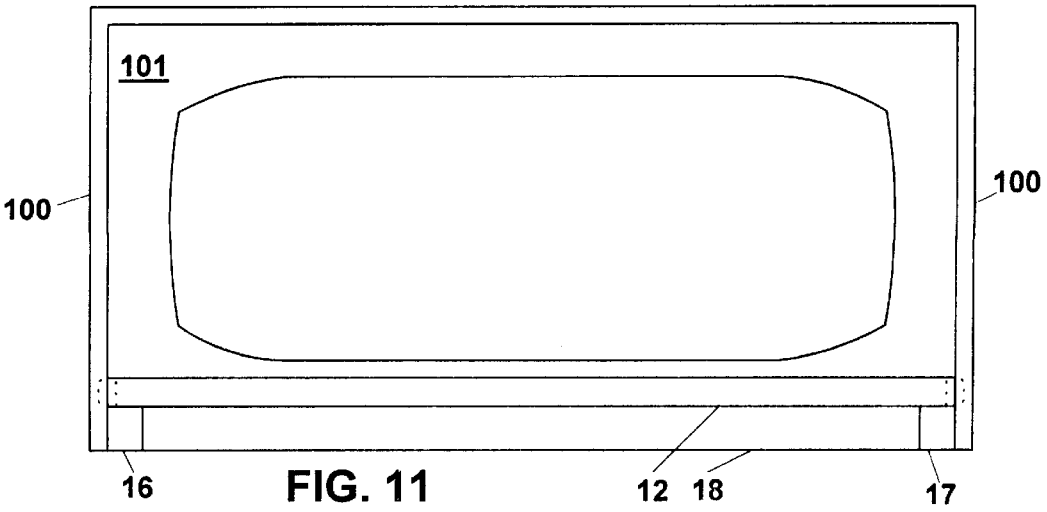
FIG. 11 shows a top view of another preferred embodiment of the present invention.

In the first preferred embodiment, shower-bathtub 1 was a solid fiberglass mold that consisted of rear and side walls, and left, right and lower dams. However, it is possible to add the present invention to an existing bathtub 101, as shown in FIG. 10 and FIG. 11. In this preferred embodiment, left dam 16 and right dam 17 are rigidly connected to existing walls 100 with glue. Caulking is then applied to the seam formed at the connection to prevent moisture from seeping through. Likewise, lower dam 18 is glued to the outside top of bathtub 101. Again, caulking is applied to prevent moisture from seeping through the connection. Upper track 12 is mounted to walls 100 as previously described.

Figure 12:
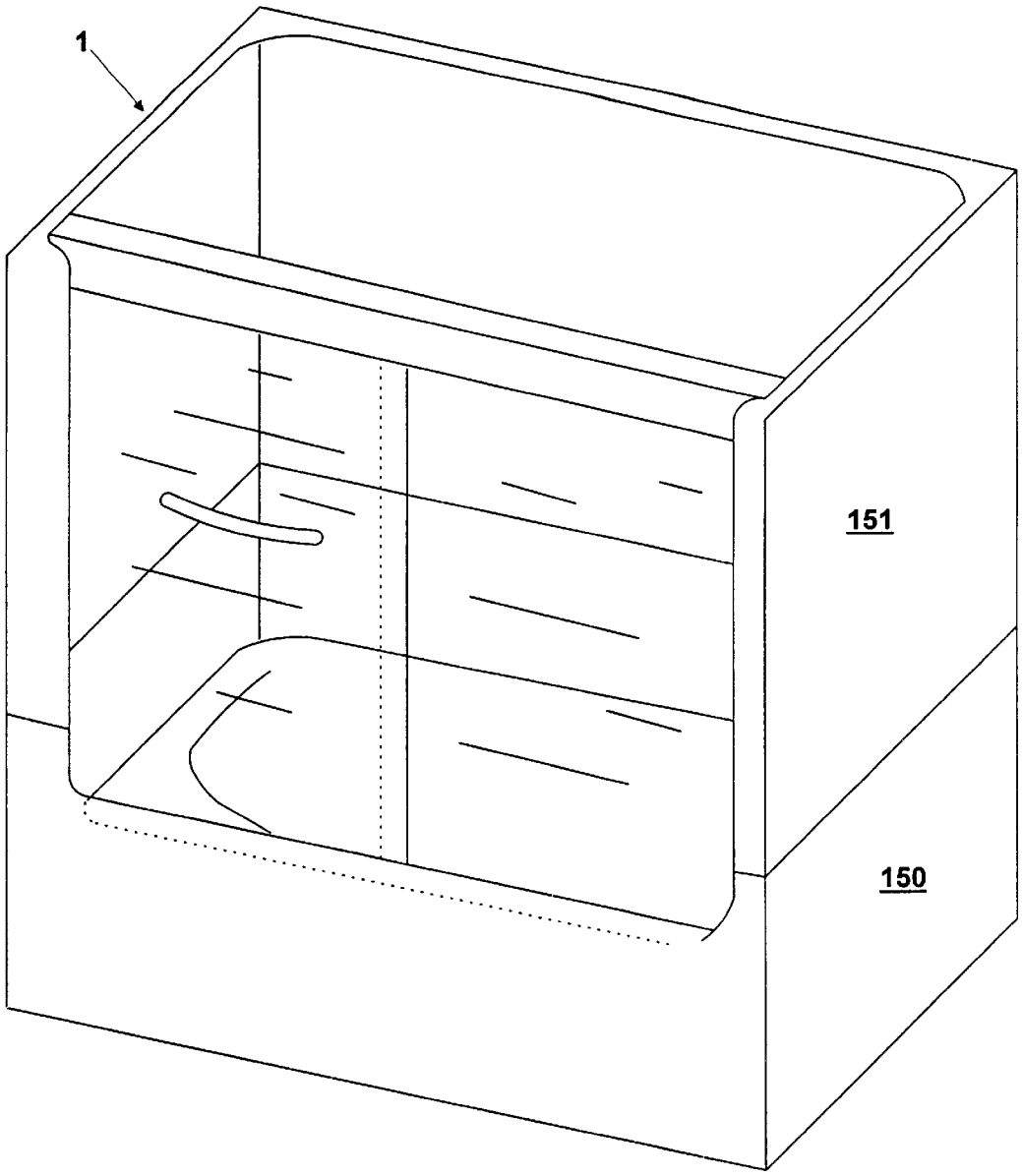
FIG. 12 shows a perspective view of another preferred embodiment of the present invention.

Another embodiment is available to deal with a problem presented by the embodiment described in FIG. 1 in that the FIG. 1 embodiment is too large to fit through many bathroom doors. Therefore, in order to get it into the bathroom, a wall would need to be torn down and then rebuilt. The embodiment shown in FIG. 12 solves this problem. Here, shower-bathtub 1 is molded into two halves; upper half 151 and lower half 150. By splitting shower-bathtub 1 into two halves, it can be more easily moved into a small bathroom through a normal size door. Once inside the bathroom, upper half 151 is lowered into position on top of lower half 150. Caulking is then placed over the seam to prevent moisture from leaking through.

Figure 14:
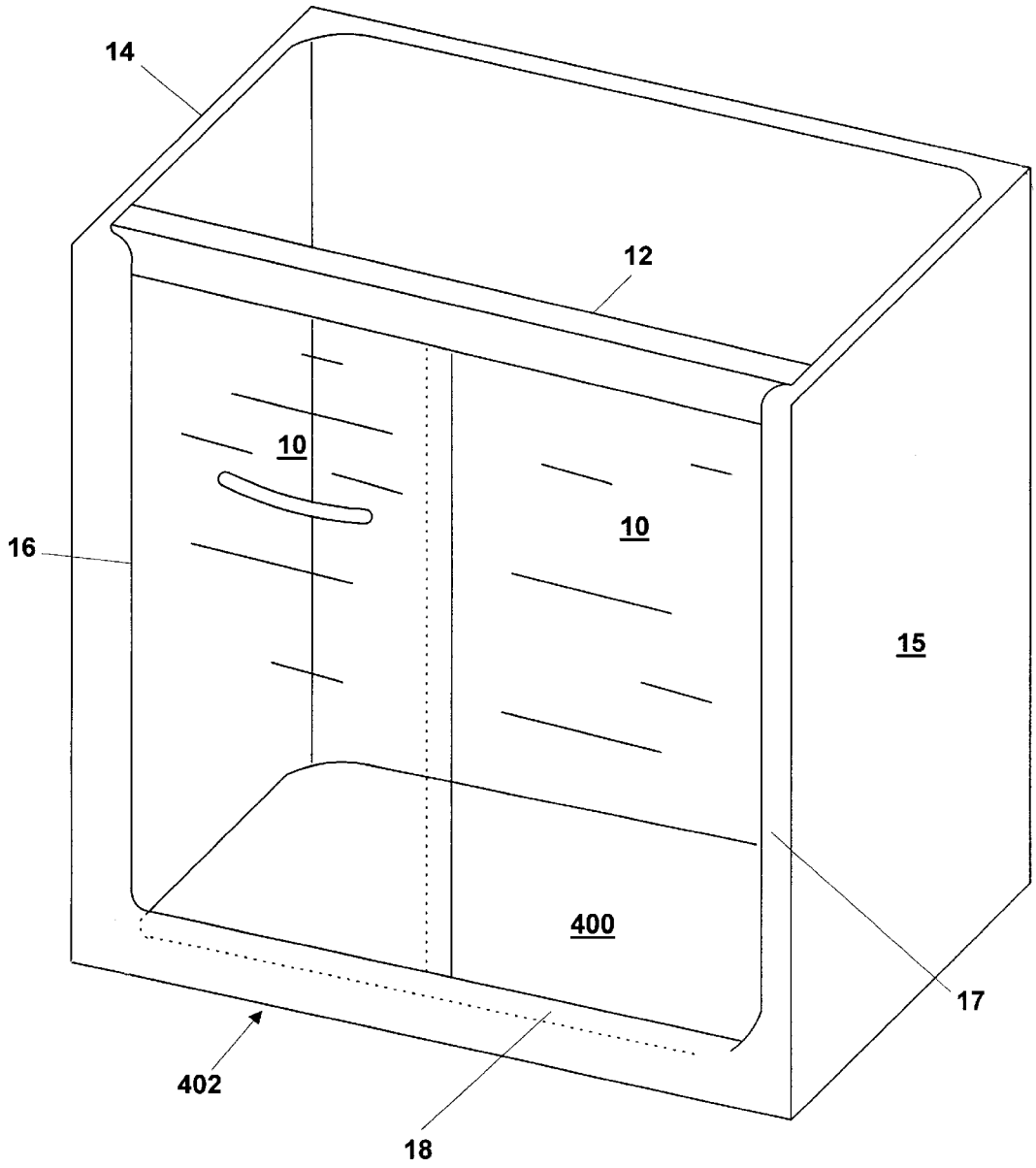
FIG. 14 shows a perspective view of another preferred embodiment of the present invention.

Although the previous embodiments have discussed utilizing the present invention with a shower-bathtub, it is also possible to apply to present invention to showers that are stand-alone. In other words, by reference to FIG. 1, if the bathtub section of shower-bathtub 1 was omitted, doors 10 and side dams 16 and 17 could be extended in length and lower dam 18 would extend upward from the floor 400 of shower 402, as shown in FIG. 14.

Figure 13:
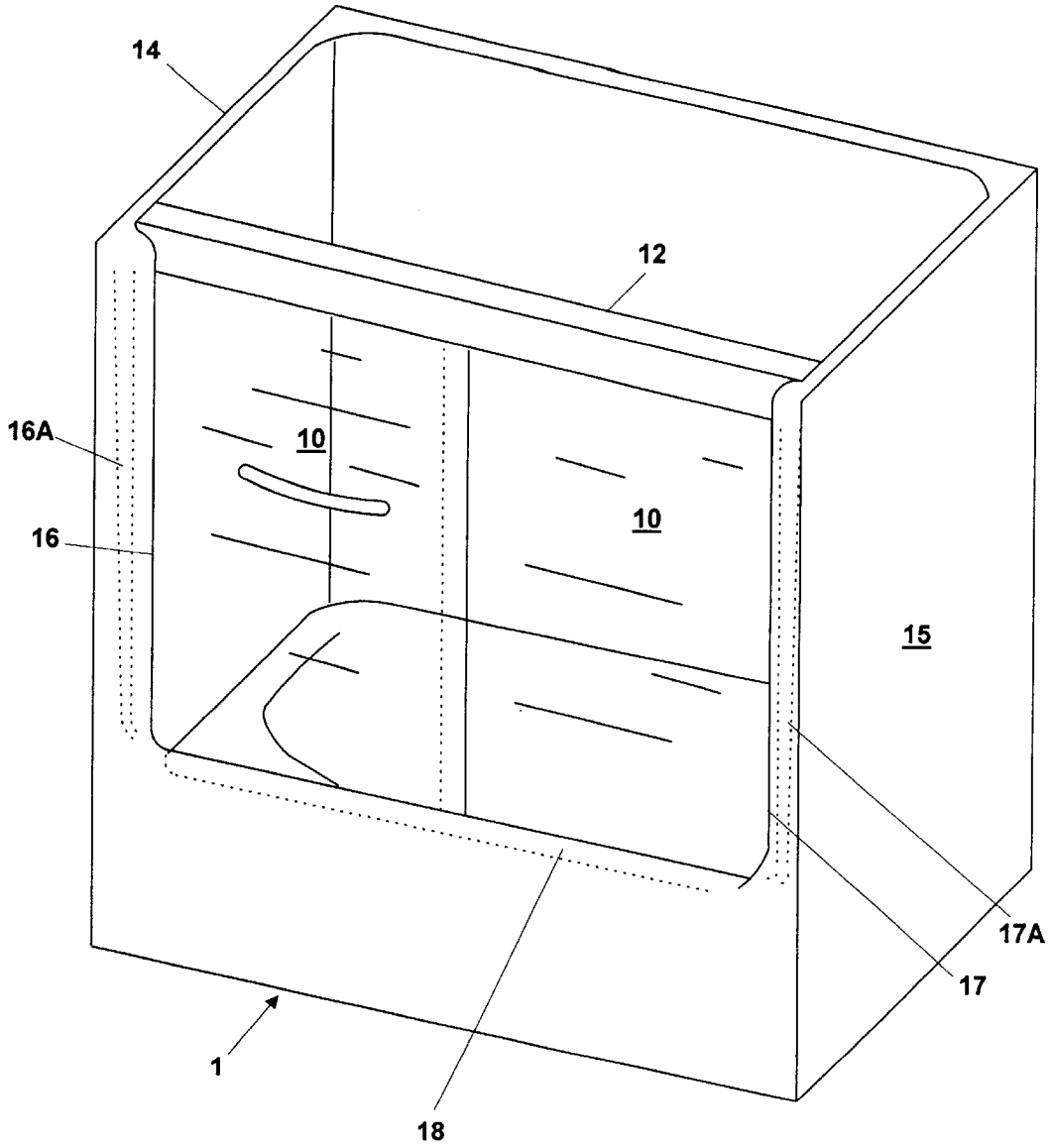
FIG. 13 shows a perspective view of another preferred embodiment of the present invention showing water runoff channels.

A further embodiment is seen by reference to FIG. 13. Side dams 16 and 17 are molded with water runoff channels 16A and 17A. Channels 16A and 17A are angled so as to direct water flow back into the tub. This aids in the prevention of mold build-up or water damage that could occur if water droplets were to stick to the side of dams 16 or 17.

The present invention has been described utilizing upper track 12 with sliding doors 10 and molded lower dam 18 and side dams 16 and 17. However, some users may prefer a shower curtain rather than sliding doors 10. A further embodiment is achieved by removing upper track 12 with sliding doors 10 and instead combining a shower curtain with molded lower dam 18 and side dams 16 and 17.

Although the above-preferred embodiments have been described with specificity, persons skilled in this art will recognize that many changes to the specific procedures disclosed above could be made without departing from the spirit of the invention. Therefore, the scope of the invention is to be determined by the appended claims and their legal equivalents.

I claim:

1. A shower-bathtub installed adjacent to three walls of a bathroom, comprising:

A) a bathtub defining four bathtub walls, said bathtub being installed with three of said four walls adjacent to said three bathroom walls and said fourth wall comprising a lower dam, B) three shower sides defining two short sides, wherein said three shower sides extend upward from three of said four bathtub walls installed adjacent to said bathroom walls, said two short sides of said three shower sides each comprising a side dam, C) an upper track, wherein said upper track is rigidly attached to said two short sides, said upper track comprising:

i) at least two wheel supports, ii) at least two wheel stays positioned above said two wheel supports, and iii) at least two lower bearing supports positioned at least five inches below said at least two wheel supports, and D) at least two sliding doors, each of said at least two sliding doors comprising, i) at least two roller assemblies rigidly connected to each of said at least two sliding doors comprising rollers positioned to roll on one of said at least two wheel supports and immediately below one of said wheel stays, and ii) at least two L-brackets rigidly connected to each of said at least two sliding doors, wherein each of said two L-brackets comprises a bearing rotationally connected to said L-bracket wherein said bearing glides in each of said two lower bearing supports to prevent rocking motion of said at least two sliding doors.

2. The shower-bathtub of claim 1, wherein said shower-bathtub, said two side dams and said lower dam is one solid fiberglass piece formed from one fiberglass mold.

3. The shower-bathtub of claim 2, wherein said one solid fiberglass piece is cut in half to form an upper half and a lower half of said one solid fiberglass piece, wherein said upper half and said lower half make it easier to install said shower door assembly.

4. The shower-bathtub of claim 1, wherein said two side dams and said lower dam are separate attachments, wherein said two side dams are rigidly connected to said two short sides, and wherein said lower dam is rigidly connected to said fourth bathtub wall.

5. The shower-bathtub as in claim 1, wherein said upper track is rigidly attached to said two short sides of said shower-bathtub by two rubber mounts, wherein said two rubber mounts extend tightly into said upper track and tightly into said two short sides of said shower-bathtub, wherein each of said two rubber mounts are further secured by two screws.

6. The shower-bathtub as in claim 1, further comprising a lower track for providing further support for said two doors.

7. The shower-bathtub as in claim 6, wherein said lower track comprises two U-shaped strips rigidly connected to said inside of said lower dam.

8. The shower-bathtub as in claim 7, wherein said at least two sliding doors further comprise at least one insert housing rigidly connected to each of said at least two sliding doors, wherein each of said at least one insert housing comprises a lower track insert slidingly connected to each of said insert housing, wherein said each lower track insert is held in place by friction force, wherein each of said lower track insert is inserted into said lower track to further prevent said rocking motion of said two doors.

9. An improvement to a sliding door system for a shower-bathtub installed adjacent to three walls of a bathroom said shower-bathtub defining a long side and two short sides and a bathtub portion of said shower-bathtub defining an outside bathtub wall said outside bathtub wall defining a top surface, said improvement comprising:

A) an upper track, comprising:

i) at least two wheel supports, ii) at least two wheel stays positioned above said two wheel supports, and iii) at least two lower bearing supports positioned at least five inches below said at least two wheel supports, wherein said upper track is adapted to be rigidly attached to said two short sides of said shower-bathtub by two rubber mounts, wherein said two rubber mounts extend tightly into said upper track and are adapted to extend tightly into said two short sides of said shower-bathtub, wherein each of said two rubber mounts are further secured by two screws, and B) at least two shower door assemblies, each shower door assembly comprising:

i) a door defining a top edge, ii) at least two rollers mounted at or near said top edge of said door and positioned to roll in said wheel support, and iii) at least one bearing mounted on said door and positioned to glide within said bearing support.

10. The improvement as in claim 9, further comprising:

A) a molded lower dam, wherein said molded lower dam extends upward from said top surface of said outside bathtub wall of said shower-bathtub and extends the full length of said outside bathtub wall of said shower-bathtub, and B) two molded side dams, wherein said two molded side dams extend inward from said two short sides of said shower-bathtub and extend the full height of said two short sides of said shower-bathtub.

11. The improvement as in claim 10, wherein said two molded side dams each comprise a water runoff channel for directing water back into said bathtub portion.

12. The improvement as in claim 10, wherein said shower-bathtub, said two molded side dams and said molded lower dam is one solid fiberglass piece formed from one fiberglass mold.

13. The improvement as in claim 12, wherein said one solid fiberglass piece is cut in half to form an upper half and a lower half of said one solid fiberglass piece, wherein said upper half and said lower half make it easier to install said shower door assembly.

14. The improvement as in claim 10, wherein said two molded side dams and said molded lower dam are separate attachments, wherein said two molded side dams are rigidly connected to said two short sides of said shower-bathtub, and wherein said molded lower dam is rigidly connected to said outside edge of said bathtub section.

15. An improvement to a sliding door system for a shower installed adjacent to three walls of a bathroom said shower defining a long side and two short sides and a floor defining a top surface, said improvement comprising:

A) an upper track, comprising:

i) at least two wheel supports, ii) at least two wheel stays positioned above said two wheel supports, and iii) at least two lower bearing supports positioned at least five inches below said at least two wheel supports, wherein said upper track is adapted to be rigidly attached to said two short sides of said shower by two rubber mounts, wherein said two rubber mounts extend tightly into said upper track and are adapted to extend tightly into said two short sides of said shower, wherein each of said two rubber mounts are further secured by two screws, and B) at least two shower door assemblies, each shower door assembly comprising:

i) a door defining a top edge, ii) at least two rollers mounted at or near said top edge of said door and positioned to roll in said wheel support, and iii) at least one bearing mounted on said door and positioned to glide within said bearing support.

16. The improvement as in claim 15, further comprising:

A) a molded lower dam, wherein said molded lower dam extends upward from said top surface of said floor of said shower and extends the full length of said floor of said shower, and B) two molded side dams, wherein said two molded side dams extend inward from said two short sides of said shower and extend the full height of said two short sides of said shower.

17. The improvement as in claim 16, wherein said two molded side dams each comprise a water runoff channel for directing water back into said shower.

18. The improvement as in claim 16, wherein said shower, said two molded side dams and said molded lower dam is one solid fiberglass piece formed from one fiberglass mold.

19. The improvement as in claim 18, wherein said one solid fiberglass piece is cut in half to form an upper half and a lower half of said one solid fiberglass piece, wherein said upper half and said lower half make it easier to install said shower door assembly.

20. The improvement as in claim 16, wherein said two molded side dams and said molded lower dam are separate attachments, wherein said two molded side dams are rigidly connected to said two short sides of said shower, and wherein said molded lower dam is rigidly connected to the outer edge of said top surface of said floor of said shower.

* * * * *